US007108494B2

(12) United States Patent
Nam

(10) Patent No.: US 7,108,494 B2
(45) Date of Patent: Sep. 19, 2006

(54) APPARATUS FOR PREVENTING THE BACKFLOW OF GAS OF SCROLL COMPRESSOR

(75) Inventor: Tae-Hee Nam, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/020,294

(22) Filed: Dec. 27, 2004

(65) Prior Publication Data

US 2006/0140797 A1 Jun. 29, 2006

(51) Int. Cl.
*F01C 1/063* (2006.01)

(52) U.S. Cl. ..... 418/55.1; 417/902; 137/533.17

(58) Field of Classification Search ..... 137/533.17, 137/533.31, 543.21; 417/559, 902; 418/55.1
See application file for complete search history.

(56) References Cited

U.S. PATENT DOCUMENTS 2,736,338 A * 2/1956 Britton ..... 137/543.21
3,109,444 A * 11/1963 McKee ..... 137/533.17
3,145,724 A * 8/1964 Pelzer ..... 137/543.21
4,766,930 A * 8/1988 Patti ..... 137/543.21
5,141,420 A * 8/1992 Nambiar ..... 417/902
5,683,236 A * 11/1997 Harrison et al. ..... 418/55.1
5,794,657 A * 8/1998 Oberg ..... 137/543.21
6,171,084 B1 * 1/2001 Wallis et al. ..... 418/55.1

FOREIGN PATENT DOCUMENTS

KP 2000-0040738 A 7/2000
KR 100173574 B1 10/1998
KR 100223431 B1 7/1999
KR 1020000040738 A 7/2000

* cited by examiner

*Primary Examiner*—Michael Koczo, Jr.
(74) *Attorney, Agent, or Firm*—Birch, Stewart, Kolasch & Birch, LLP

(57) ABSTRACT

An apparatus for preventing backflow of a gas of a scroll compressor includes: a hermetic container provided with a discharge pipe through which a gas is discharged; a fixed scroll fixedly coupled in the hermetic container; an orbiting scroll orbiting in meshing engagement with the fixed scroll to compress gas together with the fixed scroll; and a backflow preventing means for preventing backflow of a gas discharged through the discharge pipe. Therefore, a gas compressed by an orbiting movement of the fixed scroll and the orbiting scroll is smoothly discharged to the discharge pipe through the hermetic container during operation of the compressor, and the gas discharged to the discharge pipe is prevented from backflowing into the hermetic container when the operation is stopped.

9 Claims, 6 Drawing Sheets

APPARATUS FOR PREVENTING THE BACKFLOW OF GAS OF SCROLL COMPRESSOR

BACKGROUND OF THE INVENTION

1. Field of the Invention

The present invention relates to a scroll compressor, and particularly, to an apparatus for preventing backflow of a gas of a scroll compressor capable of preventing a gas, which has been discharged toward a condenser through a discharge pipe after compressed at a compression unit, from backflowing into a compressor, namely, into a hermetic container.

2. Description of the Background Art

In general, a compressor converts electric energy into kinetic energy, and compresses a refrigerant gas by the kinetic energy. The compressor is a core factor which constitutes a freezing cycle system, and there are various kinds of compressors according to a compression mechanism, such as a rotary compressor, a scroll compressor, a reciprocal compressor and the like. Such compressors are utilized in a refrigerator, an air conditioner, a showcase and the like.

The scroll compressor comprises a motor unit generating a rotary force; and a compression unit for sucking, compressing and discharging a gas as an orbiting scroll orbits in meshing engagement with a fixed scroll upon receiving a driving force of the motor unit.

FIG. 1 is a longitudinal sectional view mainly showing a compression unit of a general scroll compressor.

As shown, the compression unit of the scroll compressor includes: a fixed scroll 30 mounted in a hermetic container 10 at a certain distance from a main frame 20 mounted in the hermetic container 10; an orbiting scroll 40 positioned between the fixed scroll 30 and the main frame 20 and orbiting in meshing engagement with the fixed scroll 30; an Oldham ring 50 positioned between the orbiting scroll 40 and the main frame 20, for preventing a self-rotation of the orbiting scroll 40; a separation plate 11 coupled to the fixed scroll 30 and the hermetic container 10, for separating the inside of the hermetic container 10 into a high pressure area (H) and a low pressure area (L); and a valve assembly 60 mounted at an upper surface of the fixed scroll 30, for opening and closing a discharge hole 31 formed at the fixed scroll 30.

And the orbiting scroll 40 is connected to an eccentric portion 71 of a rotary shaft 70 inserted in the main frame 20.

A suction pipe 12 through which a gas is sucked is coupled to one side of the hermetic container 10, where the low pressure area (L) is placed, and a discharge pipe 13 through which a gas is discharged is coupled to one side of the hermetic container 10, where the high pressure area (H) is placed.

Non-explained reference numeral 32 is a wrap of the fixed scroll 30, which is protrudingly formed as an involute shape, 41 is a wrap of the orbiting scroll 40, which is protrudingly formed as an involute shape, and 'P' is a compression pocket.

The operation of the compression unit of the scroll compressor having such a structure will now be described.

First, when the rotary shaft 70 rotates upon receiving a rotary force of the motor unit, the orbiting scroll 40 coupled to the eccentric portion 71 of the rotary shaft orbits about the center of the rotary shaft 70. The orbiting scroll 40 orbits without making a self-rotation, thanks to the Oldham ring 50.

The wrap 41 of the orbiting scroll 40 orbits in meshing engagement with the wrap 32 of the fixed scroll 30 according to the orbiting movement of the orbiting scroll 40, so that a plurality of compression pockets (P) formed by the wrap 41 of the orbiting scroll 40 and the wrap 32 of the fixed scroll 30 move toward the central portions of the fixed scroll 30 and the orbiting scroll 40, and simultaneously change their volumes, thereby compressing a gas within the compression pockets. The gas compressed in the compression pockets (P) is discharged through the discharge hole 31 of the fixed scroll 30.

The high temperature high pressure gas discharged through the discharge hole 31 of the fixed scroll passes through the high pressure area (H) and then is discharged outside the hermetic container 10 through the discharge pipe 13. The high temperature high pressure gas having been discharged through the discharge pipe 13 of the scroll compressor flows toward a condenser (not shown) connected to the discharge pipe 13.

Meanwhile, a freezing cycle system including the scroll compressor is commonly mounted at an air conditioner. In such a freezing cycle system, a high temperature high pressure refrigerant gas discharged from the compressor passes through a condenser, a capillary tube and an evaporator.

However, the scroll compressor having such a structure is disadvantageous in that when the freezing cycle system stops operating, a gas which was discharged toward the condenser through the discharge pipe 13 coupled to the hermetic container 10 of the scroll compressor flows backward and is introduced into the hermetic container 10. Thus, in reoperation of the scroll compressor, compression efficiency is degraded.

SUMMARY OF THE INVENTION

Therefore, an object of the present invention is to provide an apparatus for preventing backflow a gas of a scroll compressor capable of preventing a gas, which has been discharged toward a condenser through a discharge pipe after compressed in the compressor, from backflowing into the compressor, namely, a hermetic container.

To achieve these and other advantages and in accordance with the purpose of the present invention, as embodied and broadly described herein, there is provided an apparatus for preventing backflow of a gas of a scroll compressor comprising: a hermetic container provided with a discharge pipe through which a gas is discharged; a fixed scroll fixedly coupled in the hermetic container; an orbiting scroll orbiting in interlocking with the fixed scroll to compress gas together with the fixed scroll; and a backflow preventing means for preventing backflow of a gas discharged through the discharge pipe.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a unit of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
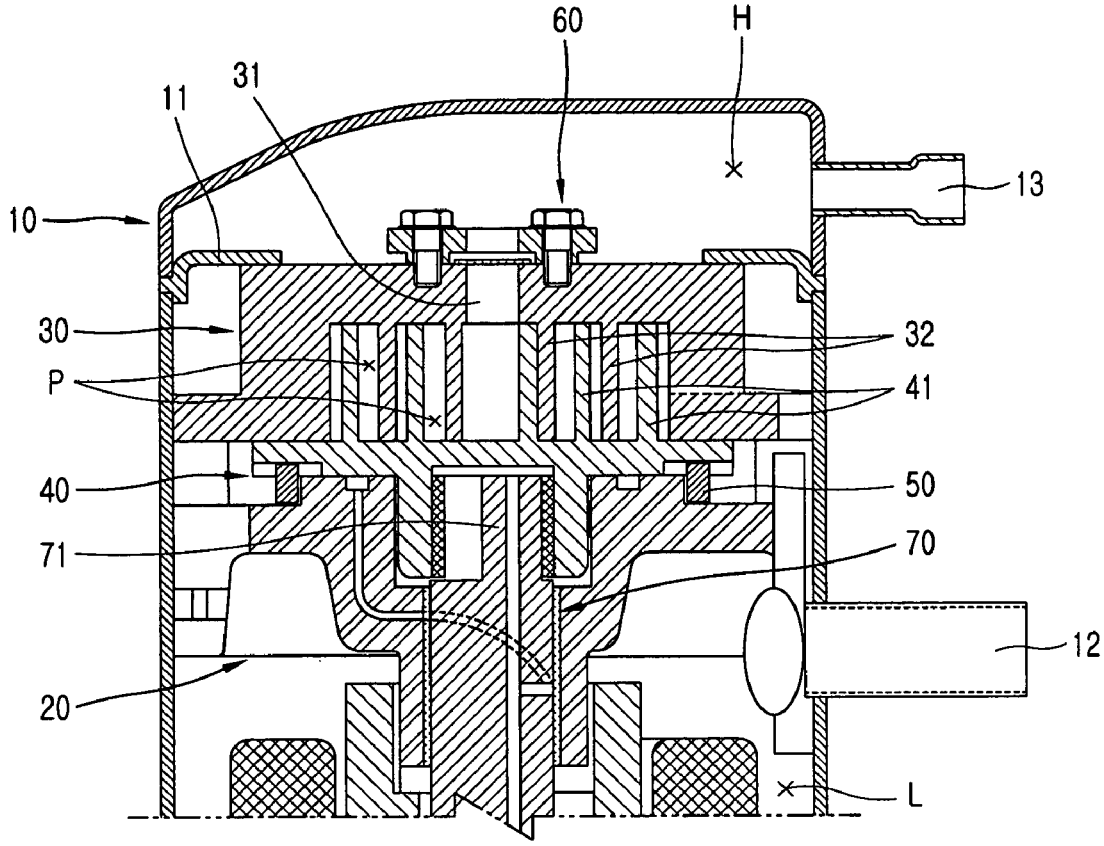
FIG. 1 RELATED ART
FIG. 1 is a sectional view showing a compression unit of a conventional scroll compressor.
Figure 2:
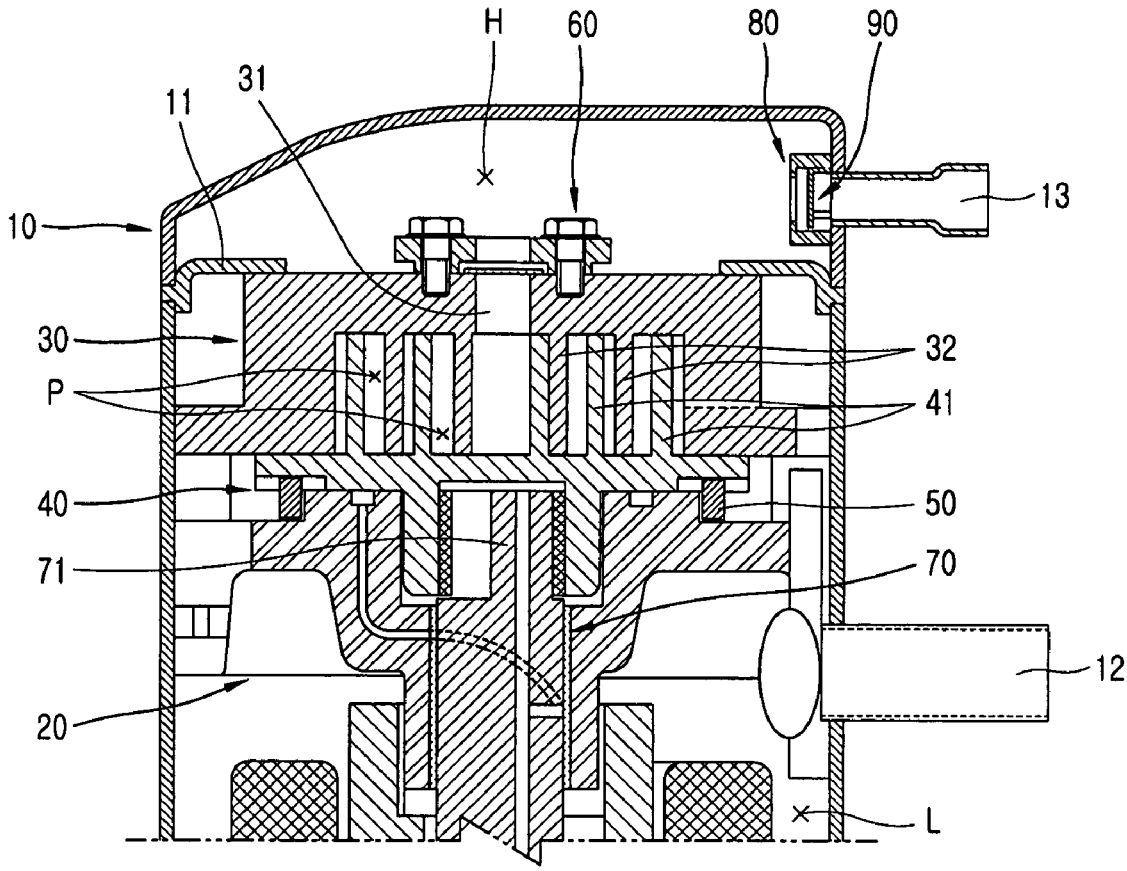
FIG. 2 is a sectional view of a compressor unit provided with an apparatus for preventing backflow of a gas of a scroll compressor in accordance with one embodiment of the present invention.

FIG. 2 is a sectional view mainly showing a compression unit of a scroll compressor provided with an apparatus for preventing backflow of a gas in accordance with one embodiment of the present invention. Like reference numerals designate like or corresponding parts to those of the conventional art.

As shown, the scroll compressor includes: a fixed scroll 30 mounted in a hermetic container 10 at a certain distance from a main frame 20 mounted in the hermetic container 10; an orbiting scroll 40 positioned between the fixed scroll 30 and the main frame 20 and orbiting in meshing engagement with the fixed scroll 30; an Oldham ring 50 positioned between the orbiting scroll 40 and the main frame 20, for preventing a self-rotation of the orbiting scroll 40; a separation plate 11 coupled to the fixed scroll 30 and the hermetic container 10, for separating the inside of the hermetic container 10 into a high pressure area (H) and a low pressure area (L); and a valve assembly 60 mounted at an upper surface of the fixed scroll 30, for opening or closing a discharge hole 31 formed at the fixed scroll 30.

The orbiting scroll 40 is connected to an eccentric portion 71 of a rotary shaft 70 inserted in the main frame 20.

A suction pipe 12 through which a gas is sucked is coupled to one side of the hermetic container 10 where the low pressure area (L) is placed, and a discharge pipe 13 through which a gas is discharged is coupled to one side of the hermetic container 10, where the high pressure area (H) is placed.

Such construction is the same as the one described above.

Also, a backflow preventing means for preventing a gas, which has been discharged through the discharge pipe 13, from backflowing into he hermetic container is provided.

The backflow preventing means opens or closes the discharge pipe 13 by a pressure differential between the hermetic container 10 and the discharge pipe 13.

Figure 3:
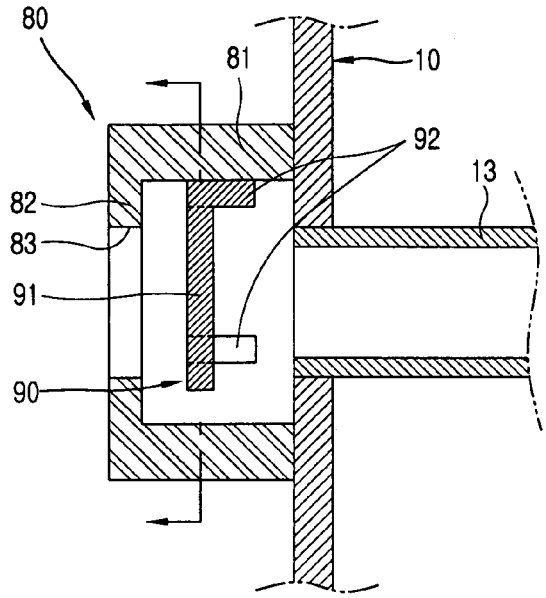
FIGS. 3 and 4 are a front sectional view and a side sectional view showing the apparatus for preventing backflow of a gas of a scroll compressor in accordance with one embodiment of the present invention.
Figure 4:
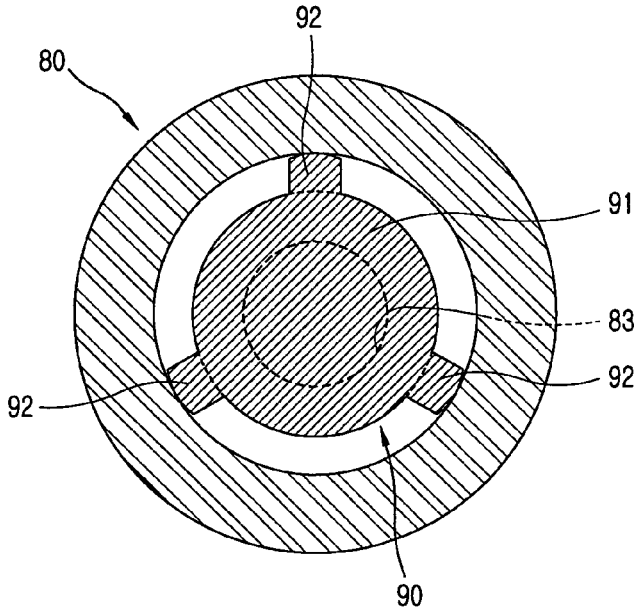

As shown in FIGS. 3 and 4, the backflow preventing means includes: a valve housing 80 having an inner passage of a predetermined shape, and fixedly coupled inside the hermetic container 10, allowing the inner passage to communicate with the discharge pipe 13; and a check valve 90 movably inserted in the valve housing 80 for opening or closing the inner passage by the pressure differential.

The valve housing 80 is provided with a cylindrical portion 81 formed as a cylindrical shape having certain length and inner diameter, and coupled to an inner wall of the hermetic container 10 at its one side; a covering portion 82 for covering one side of the cylindrical portion 81; and a penetration hole 83 penetratingly formed at the covering portion 82 and opened or closed by the check valve 90.

Preferably, an inner diameter of the cylindrical portion 81 is greater than that of the discharge pipe 13, and an inner diameter of the penetration hole 83 is the same as that of the discharge pipe 13.

The check valve 90 includes: a opening/closing portion 91 having a predetermined area; and distance-maintaining portions 92, each portion extending from an outer circumferential surface of the opening/closing portion 91 at a certain length in a bending manner, contacting with an inner wall of the valve housing 80 and maintaining a certain distance between an inlet side of the discharge pipe 13 and the opening/closing portion of the check valve 90.

The opening/closing portion 91 is formed as a disc shape with a certain thickness, and its outer diameter is greater than an inner diameter of the penetration hole 83 and is smaller than the covering portion 82. It is preferable to form three distance-maintaining portions 92 and to make intervals therebetween regular.

As for the valve housing 80, an end surface of the cylindrical portion 81 is in contact with an inner wall of the hermetic container 10, and an inlet side of the discharge pipe 13 is positioned in the cylindrical portion 81. A sealing member (not shown) is preferably inserted between the valve housing 80 and the inner wall of the hermetic container 10. The inside and the penetration hole 83 of the valve housing 80 form an inner passage.

The check valve 90 is inserted in the valve housing 80 with its distance-maintaining portions 92 positioned toward the inner wall of the hermetic container 10 and with its opening/closing portion 91 positioned toward the covering portion 82. At this time, a side surface of each distance-maintaining portion 92 is slidably in contact with an inner circumferential wall of the cylindrical portion 81.

Figure 5:
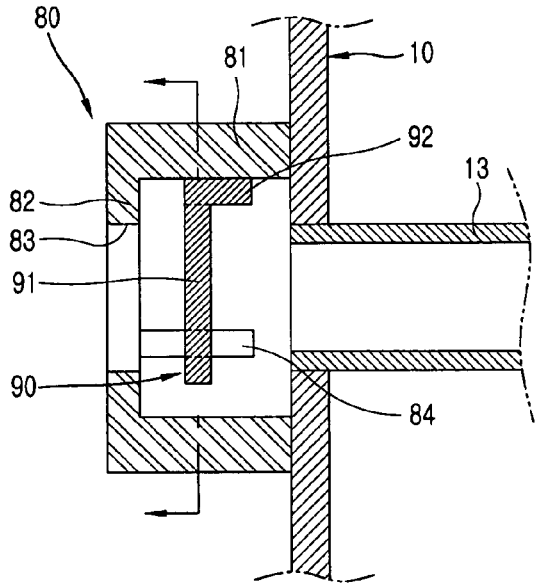
FIGS. 5 and 6 are a front sectional view and side sectional view showing a modified example of a valve housing and a check valve constituting the apparatus for preventing backflow of a gas of the scroll compressor in accordance with the present invention.
Figure 6:
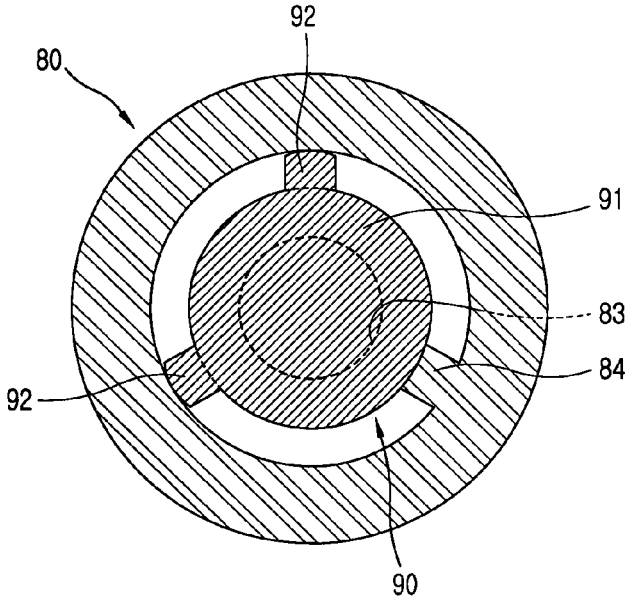

As a modified example of the valve housing 80 and the check valve 90, as shown in FIGS. 5 and 6, two distance-maintaining portions 92 of the check valve are formed, and a guide protrusion portion 84 having certain height and length is formed at an inner circumferential wall of the cylindrical portion 81 of the valve housing. Reference numerals of FIGS. 3 and 4 designate to like or corresponding parts throughout FIGS. 5 and 6.

As described above, the valve housing 80 is coupled to an inner wall of the hermetic container 10, and the check valve 90 is positioned inside the cylindrical portion 81 of the valve housing. At this time, the two distance-maintaining portions 92 of the check valve 90 are slidably in contact with an inner circumferential wall of the cylindrical portion 81, an outer circumferential surface of the opening/closing portion 91 of the check valve 90 is slidably in contact with an inner surface of the guide protrusion portion 84 of the valve housing. Thus, two distance-maintaining portions 92 of the check valve 90 contact with and are supported by the inner circumferential wall of the cylindrical portion 81 of the valve housing, and the guiding protrusion portion 84 of the valve housing 80 and the outer circumferential surface of the opening/closing portion 91 are in contact with each other. Namely, the valve housing 80 and the check valve 90 are supported at three points, thereby achieving a stable coupling state.

Figure 7:
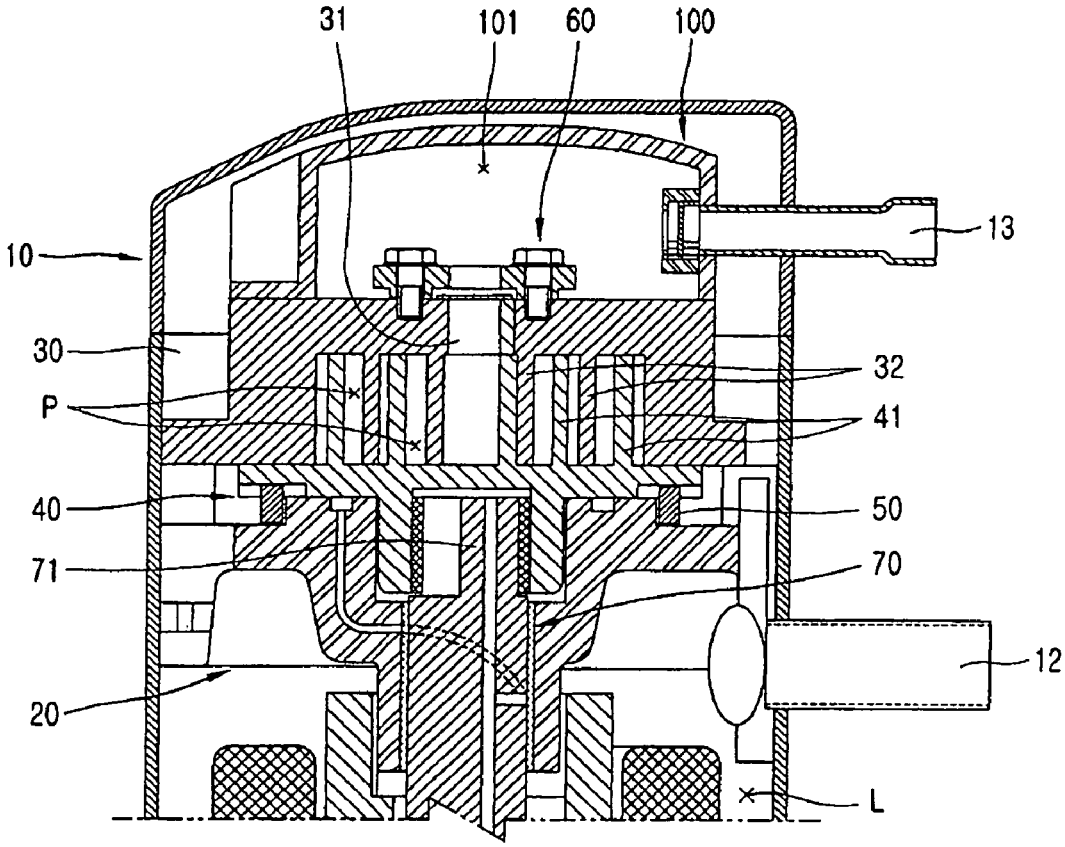
FIG. 7 is a sectional view showing the apparatus for preventing backflow of a gas of the scroll compressor in accordance with another embodiment of the present invention.

In FIG. 7, another embodiment of the present invention is depicted. As shown, a cover 100 for covering a discharge hole 31 of the fixed scroll is coupled to an upper surface of the fixed scroll 30, and a chamber 101 is formed by the cover 100 and the upper surface of the fixed scroll 30. And the discharge pipe 13 penetrates the hermetic container 10 and is coupled to the cover 100, communicating with the chamber 100. Also, the backflow preventing means is mounted in the cover 100, communicating with the discharge pipe 13. As described above, the backflow preventing means includes a valve housing 80 coupled to an inner wall of the cover 100 and a check valve 90 movably inserted in the valve housing 80. The specific shapes of the valve housing 80 and the check valve 90 are the same as those in the above descriptions.

Non-explained reference numeral 32 is a wrap of the fixed scroll 30, which is protrudingly formed as an involute shape, 41 is a wrap of the orbiting scroll 40, which is protrudingly formed as an involute shape, and 'P' is a compression pocket.

The operation and the effect of an apparatus for preventing backflow of a gas of the scroll compressor in accordance with the present invention will now be described.

As described above, when the rotary shaft 70 rotates upon receiving a rotary force of a motor unit, the orbiting scroll 40 coupled to the eccentric portion 71 of the rotary shaft orbits about the center of the rotary shaft 70. According to the orbiting movement of the orbiting scroll 40, the wrap 41 of the orbiting scroll 40 orbits in meshing engagement with the wrap 32 of the fixed scroll 30, thereby compressing a gas. The compressed high temperature high pressure gas is discharged to the high pressure area (H) of the hermetic container 10 through the discharge hole 31 of the fixed scroll.

The gas discharged to the high pressure area (H) of the hermetic container 10 is discharged outside the hermetic container 10 through the discharge pipe 13.

Figure 8:
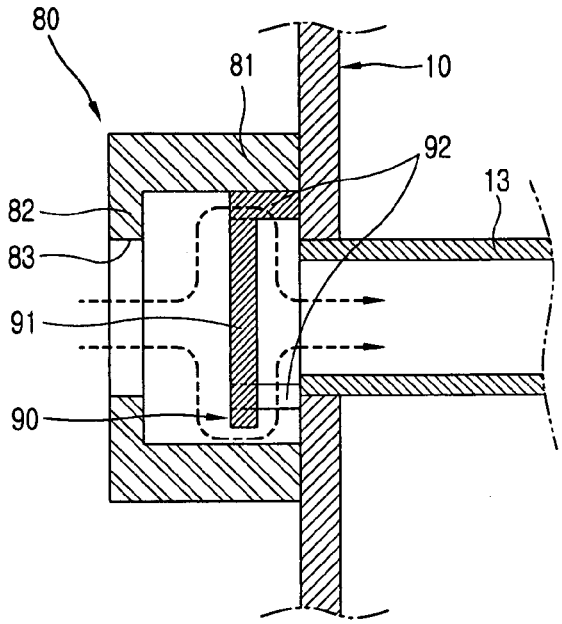
FIGS. 8 and 9 are sectional views, each view showing an operation state of the apparatus for preventing backflow of a gas of the scroll compressor in accordance with the present invention.

As the gas is discharged to the high pressure area (H) of the hermetic container 10 through the discharge hole 31 of the fixed scroll, pressure of the high pressure area (H) of the hermetic container becomes relatively high. Accordingly, as shown in FIG. 8, the check valve 90 positioned in the valve housing 80 slides toward the discharge pipe 13. At this time, the distance-maintaining portions 92 of the check valve 90 slide along an inner circumferential surface of the valve housing 80. The check valve 90 is positioned with its distance-maintaining portions 92 supported by an inner wall of the hermetic container 10 by the high pressure in the hermetic container 10, so that a certain distance between the opening/closing portion 91 of the check valve and an inlet of the discharge pipe 13 is maintained. Accordingly, a gas in the hermetic container 10 is introduced into the valve housing 80 through the penetration hole 83 of the valve housing. And the introduced gas flows into the discharge pipe 13 through a gap between the opening/closing portion 91 of the check valve and an inlet of the discharge pipe 13.

The high temperature high pressure gas having flowed out through the discharge pipe 13 of the scroll compressor passes through a condenser, a capillary tube and an evaporator.

Figure 9:
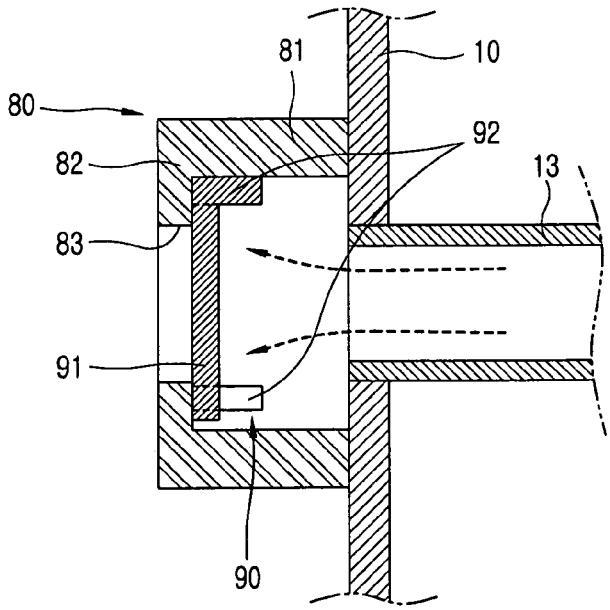

Meanwhile, when the scroll compressor stops operating, the orbiting scroll 40 which orbits in meshing engagement with the fixed scroll 30 is stopped, and thus discharging of a gas to the high pressure area (H) of the hermetic container through the discharge hole 31 of the fixed scroll is stopped. For this reason, the pressure in the high pressure area (H) of the hermetic container becomes relatively lower than that of a gas discharged through the discharge pipe 13, whereby the gas discharged through the discharge pipe 13 flows backward. However, as shown in FIG. 9, because the pressure in the hermetic container 10 becomes lower than the pressure in the discharge pipe 13, the check valve 90 positioned in the valve housing 80 moves toward the covering portion 82 of the valve housing, so that the opening/closing portion 91 of the check valve blocks the penetration hole 83 formed at the covering portion 82. Therefore, the gas discharged to the discharge pipe 13 is prevented from flowing backward into the hermetic container 10.

According to another embodiment of the present invention, if the cover 100 is coupled to an upper surface of the fixed scroll 30, the chamber 101 formed by the cover 100 and the upper surface of the fixed scroll 30 becomes a high pressure area (H) of the hermetic container. Accordingly, the gas discharged through the discharge hole 31 of the fixed scroll flows to the discharge pipe 13 through the chamber 101. The backflow preventing means provided in the chamber 101 is operated in the above-described manner, thereby preventing backflow of the gas.

As so far described, in the apparatus for preventing backflow of a gas of the scroll compressor in accordance with the present invention, a gas compressed by an orbiting movement of a fixed scroll 30 and an orbiting scroll 40 is smoothly discharged to a discharge pipe 13 through a hermetic container 10 during operation of the compressor, and the gas discharged to the discharge pipe 13 is prevented from flowing backward into the hermetic container 10 when the operation is stopped. Accordingly, degradation in compression efficiency in case of re-operation is prevented, thereby improving compression efficiency.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An apparatus for preventing backflow of a gas of a scroll compressor comprising:

a hermetic container provided with a discharge pipe through which a gas is discharged;

a fixed scroll fixedly coupled in the hermetic container;

an orbiting scroll orbiting in interlocking with the fixed scroll to compress gas together with the fixed scroll; and a backflow preventing means for preventing backflow of a gas discharged through the discharge pipe;

wherein the backflow preventing means comprises:

a valve housing having an inner passage of a predetermined shape and fixedly coupled inside the hermetic container with its inner passage communicating with the discharge pipe;

a check valve movably inserted in the valve housing, for opening or closing the inner passage by a pressure differential;

wherein the valve housing comprises:

a cylindrical portion formed as a cylindrical shape with certain length and inner diameter and coupled to an inner wall of the hermetic container at its one side;

a covering portion for covering one side of the cylindrical portion; and a penetration hole penetratingly formed at the covering portion and opened or closed by the check valve; and a guide protrusion portion having certain height and length is formed at an inner circumferential surface of the cylindrical portion.

2. The apparatus of claim 1, wherein the backflow preventing means opens or closes the discharge pipe by a pressure differential between the hermetic container and the discharge pipe.

3. The apparatus of claim 1, wherein the backflow preventing means comprises:

a valve housing having an inner passage of a predetermined shape and fixedly coupled inside the hermetic container with its inner passage communicating with the discharge pipe; and a check valve movably inserted in the valve housing, for opening or closing the inner passage by a pressure differential.

4. The apparatus of claim 3, wherein the check valve is provided with a distance-maintaining portion for maintaining a certain distance from an inlet side of the discharge pipe.

5. The apparatus of claim 3, wherein the valve housing comprises:

a cylindrical portion formed as a cylindrical shape with certain length and inner diameter and coupled to an inner wall of the hermetic container at its one side;

a covering portion for covering one side of the cylindrical portion; and a penetration hole penetratingly formed at the covering portion and opened or closed by the check valve.

6. The apparatus of claim 5, wherein an inner diameter of the penetration hole is the same as an inner diameter of the discharge pipe.

7. The apparatus of claim 5, wherein an inner diameter of the cylindrical portion is greater than an inner diameter of the discharge pipe.

8. An apparatus for preventing backflow of a gas of a scroll compressor comprising:

a hermetic container provided with a discharge pipe through which a gas is discharged;

a fixed scroll fixedly coupled in the hermetic container;

an orbiting scroll orbiting in interlocking with the fixed scroll to compress gas together with the fixed scroll; and a backflow preventing means for preventing backflow of a gas discharged through the discharge pipe;

wherein a cover for covering a discharge opening of the fixed scroll is provided at an upper surface of the fixed scroll, thereby forming a chamber therein, the discharge pipe is coupled to the cover, communicating with the chamber, and the backflow preventing means is provided in the cover.

9. The apparatus for preventing backflow of a gas of a scroll compressor of claim 8, wherein:

the cover is separate and apart from the hermetic container and forms a separate chamber within the hermetic container.

* * * * *